United States Patent [19]

Franz et al.

[11] Patent Number: 4,658,747

[45] Date of Patent: Apr. 21, 1987

[54] SHIP WITH SEVERAL DECKS HAVING LONGITUDINAL AND LATERAL SUPPORT ELEMENTS ARRANGED IN A GRID

[75] Inventors: Hans-Joachim Franz, Kölln-Reisiek; Karl-Otto Sadler, Hamburg; Willi Schmidt, Ellerbek, all of Fed. Rep. of Germany

[73] Assignee: Blohm & Voss AG, Hamburg, Fed. Rep. of Germany

[21] Appl. No.: 580,611

[22] Filed: Feb. 16, 1984

[30] Foreign Application Priority Data

Feb. 16, 1983 [DE] Fed. Rep. of Germany ..... 3305322

[51] Int. Cl.[4] ..... B63B 3/48

[52] U.S. Cl. ..... 114/85; 114/364; 114/77 R; 52/79.1

[58] Field of Search ..... 52/79.1; 114/83, 85, 114/116, 78, 364, 77 R, 77 A, 79 R

[56] References Cited

U.S. PATENT DOCUMENTS

| | | | |
|---|---|---|---|
| 2,218,688 | 10/1940 | Stewart | 114/116 |
| 2,506,549 | 5/1950 | Kervarrec | 114/83 |
| 2,585,134 | 2/1952 | Kennedy | 114/79 R |

FOREIGN PATENT DOCUMENTS

| | | | |
|---|---|---|---|
| 1059320 | 11/1953 | France | 114/79 R |
| 655318 | 7/1963 | Italy . | |

*Primary Examiner*—Joseph F. Peters, Jr.
*Assistant Examiner*—Thomas J. Brahan
*Attorney, Agent, or Firm*—Nils H. Ljungman

[57] ABSTRACT

A maritime structure such as a ship, and in particular a warship, has a plurality of vertically spaced decks which bear foundation seatings, hatches and/or assembly openings; in the plane of each deck, longitudinal parallel support elements, and lateral support elements are arranged in the form of a unit grid, which has longitudinal and transverse grid lines forming a matrix of grid units. The longitudinal grid lines, as well as the transverse grid lines are located at predetermined uniform spacing, the spacing of the lateral grid lines being perferably twice the spacing of longitudinal grid lines. The load bearing longitudinal and transverse beams and girders of base support units and the functional units, pallets, support frames, modules, deck houses, etc., as well as the hatches, assembly openings and access openings are incorporated into the unit grid; in other words, said girders and beams are disposed to coincide with said longitudinal and transverse grid lines. Some pairs of beams which run in the same direction and are on superjacent decks, have vertical wall-members bridging them; the vertical wall-members may be load-bearing and may have access-openings of predetermined size in them. Functional units may be easily replaced, removed and shifted on any deck easily.

19 Claims, 14 Drawing Figures

TYP 86
15
14
11
12
23
24
25
26
27
39
40
41

18
17
19
20
42
41
R

SHIP WITH SEVERAL DECKS HAVING LONGITUDINAL AND LATERAL SUPPORT ELEMENTS ARRANGED IN A GRID

FIELD OF THE INVENTION

The invention concerns a maritime structure such as a ship, in particular a warship or an offshore rig, with several vertically arranged decks which are designed to carry devices, fixtures, apparatus, foundations, hatches and/or assembly openings; along the length of the decks, arranged in parallel at a suitable spacing, are longitudinal support elements, such as longitudinal beams, longitudinal strips, deck girders, longitudinal walls, longitudinal bulkheads; along the width of the decks are provided lateral support elements, such as lateral beams, lateral frames, frame girders, spars, lateral walls, lateral bulkheads. Between some of the longitudinal and/or lateral support elements of superjacent decks are arranged longitudinal walls and/or bulkheads which can also function as support elements, and of which at least one is equipped with access openings. The term "ship" in this case is used in the broadest sense, so that it can also encompass off-shore platforms, etc.

BACKGROUND OF THE INVENTION AND DESCRIPTION OF PRIOR ART

For more economical construction of warships, and to facilitate modernization, it is known from German publication No. DE PS 20 56 069 to furnish unit seating bases on the topside deck, on which weapons systems, fire control systems or navigational systems of known physical dimensions can be installed and interchanged when necessary as functional units. Because of such design, the functional unit systems can be constructed simultaneously with the construction of the ship's hull in a separate manufacturing operation, and subsequently installed on the individual unit support bases on the ship's deck. In this manner, practically no additional time may be required for the installation of the system in the ship. An additional advantage of such functional unit system lies in the fact that the functional unit installed in the ship can be removed at any time for maintenance or replacement purposes.

There are, however, nonstandardized devices, fixtures, systems and apparatus not only on the topside deck of a ship, but also at numerous locations in the interior of the ship on the lower decks. These devices, fixtures, systems and apparatus must likewise be easily transported into the ship and installed in such a way that they can be removed or interchanged easily. In prior art arrangements, however, for repair and maintenance work on the various systems, access ways had to be frequently made available over several decks, amounting to an enormous expense during the operational life of the ship. Retrofitting and/or modernization work which is required in such instances, often involves entire departments and sections, and the secondary costs incurred frequently exceed the cost of the actual retrofitted or modernized system several times over.

OBJECT OF THE INVENTION AND DEFINITION OF THE INVENTION

The purpose of the invention, therefore, is to provide a ship of the type described above, in which in addition to the functional unit systems being arranged on the topside deck, also, the devices, fixtures, systems and apparatus to be located in the interior of the ship individually or as functional units or modules are standardized and, cannot only be easily transported into and installed in the ship, but also dismantled and removed from the ship when repairs or replacement are required, with a minimum of expense for the establishment of access ways.

Furthermore, the invention provides for better conditions for securing, modernizing, retrofitting, etc., the weapons systems (torpedo tubes, chaff rocket launchers, etc.), which currently cannot be integrated into the unit foundation system because of their size, as well as antennae, sensors and other systems arranged on deck.

Finally, the invention purports to lessen the cost, improve the quality, and further standardize the planning, design and construction of the ship To this end, the invention provides longitudinal support elements and lateral support elements which are arranged along certain grid lines of a unit grid incorporated into the plan of the ship, wherein the longitudinal grid lines as well as the lateral grid lines are uniformly spaced; and, the base supports, hatches, assembly openings and access openings are chosen to be one of several standardized dimensions arranged in the unit grid.

The invention in its broad form comprises a maritime structure of the type having a plurality of vertically spaced decks each having a length and a width, at least one of said decks being adapted to receive foundation seatings of equipment and apparatus comprising weapon containers, weapons, navigational systems, disposed to form an arrangement, said arrangement comprising: a plurality of uniform spaced longitudinal grid lines along the length of each deck at a first known spacing, a plurality of uniformly spaced lateral grid lines parallel to the deck width and spaced at a second known spacing, said first spacing and second spacing having a predetermined relationship; longitudinal and transverse load bearing beams and girders forming support bases, assembly-openings, hatches and transport openings, all such beams and girders being substantially horizontal and at least in part being aligned with selected of said longitudinal and transverse grid lines; some of said longitudinal beams being disposed in a given vertical plane on superjacent decks in paired beams at least some said paired beams including therebetween vertical load bearing wall members, at least some of said vertical load bearing wall-members having access openings of predetermined dimensions which are derived from said first and second spacings, whereby, said apparatus and equipment dimensions can be standardized and prefabricated in terms of said first and second grid spacings, enabling easy installation, maintenance and replacement of said apparatus and equipment.

A preferred embodiment shown herein describes a ship hull for a ship, preferably a warship or auxiliary warship, whose bulkheads, walls, foundations, frame girders, beams and deck girders are essentially arranged along the certain grid lines; any required rooms, hatches, assembly openings, access ways and access openings, depending on size and position, are incorporated in this unit grid. The individual decks inside the ship, however, may have any standard vertical spacing The uniform grid arrangement in the ship's hull makes possible the standardization of structural components (-and their relationships-) such as deck houses, functional units, rooms, room modules, pallets, support frames, etc. The inventive design also simplifies the integration, exchangeability, retrofitting as well as repair and maintenance conditions of all on-board systems of a warship, for example.

The grid, is composed of uniformly spaced longitudinal and transverse lines in the plane of each deck, for all decks; the grid governs the layout and the arrangement of bulkheads, walls, frame girders, foundations, hatches, openings, access ways, as well as the incorporation of functional units, room modules, pallets, support frames, etc. The longitudinal grid lines have preferably half the spacing of the lateral grid lines. The spacing of the lateral grid lines is, for example, 60 cm, that of the longitudinal grid lines 30 cm.

The bulkhead and lateral support-element-spacing may advantageously be an integral multiple of the lateral grid line spacing, the smallest multiple being 1. For a basic lateral grid line spacing of 60 cm, possible spacing of the lateral support elements are 60, 120, 180 cm etc.

The spacing of the longitudinal support elements, such as, for example, the deck girders and longitudinal beams, is advantageously made to be an integral multiple of the longitudinal grid line spacing, i.e., an integral multiple of 30 cm, for example; it is recognized again that the smallest is 1.

Possible preferred deck girder and longitudinal beam spacings are, therefore, 30, 60, 90 cm, etc.

It is particularly useful for purposes of standardization if the width of the support bases (foundations), assembly openings, hatches and/or access openings correspond to an integral multiple of the lateral grid spacing.

It is also advantageous if adjacent longitudinal or lateral support elements are arranged with double the spacing of the grid lines, with a spacing equal to the spacing of the grid lines only at particularly heavily stressed locations. In this way, there are additional provisions for reinforcing the deck in case reinforcement of the areas around the openings becomes necessary.

The central longitudinal grid line is advantageously located in the center of the ship, resulting in the fact that the spacing of the longitudinal walls and the outer shell (in the straight section of the ship) from the ship's center are also multiples of the longitudinal grid line spacing of 30 cm, for example.

It is also important that the longitudinal and lateral reinforcements in the walls are also incorporated into the unit grid. Not only the support bases and the openings for containers, assembly openings, hatches and doors, but also all reinforcements, bulkheads and walls are preferably included in the grid sections.

An advantageous practical embodiment of the inventive idea is characterized in that the webs which are essentially the inside edges of the foundations, are associated with the grid lines, consequently, the substructures of the ship, and the bearing surfaces for the mounting flanges of the platforms to be mounted will project beyond the grid lines. The foundations in the form of support bases used for mounting functional units, pallets, etc., are primarily arranged on deck. The unit foundation can, for example, incorporate an opening for a functional unit, which is then essentially bordered by the lateral and longitudinal grid lines, but the opening projects slightly to the inside of these grid lines. The functional unit to be passed through the opening is standardized and has somewhat smaller dimensions than the opening.

A modified arrangement can be chosen for the assembly openings, characterized in that the edges of the assembly openings are offset to the inside of the grid lines, in order to accommodate a flange for mounting a cover on the assembly opening. After assembling the cover, this provides a continuous, stepless surface which serves as foundation base for the overlapping arrangement of a functional unit, pallet, etc.

Incorporation of the access openings in the interior of the hull of the ship on the inventive unit grid system is preferably accomplished in the following manner: the rectangular access openings adapted to the modular grid are somewhat larger in height and width than the unit grid. It is assumed that the height of the access opening is at least equal to its width. The dimensions of the opening are preferably so selected that the height and width of the access openings are 5 to 15% larger, (and most favorably about 10%), larger than the spacing of the lateral grid lines.

In this manner, the devices, fixtures, apparatus and systems adapted to the grid according to the invention can be easily conveyed through the access openings into the ship, provided that the apparatus dimensions do not exceed the grid dimensions of the corresponding access opening in at least one plane. In general, the access openings have widths corresponding to roughly a single lateral grid line spacing and heights corresponding to roughly single, double or triple grid line spacing. Such being the case, at least the smaller apparatus adapted to the unit grid dimensions can be transported inside the ship in both longitudinal and lateral directions.

It is especially preferable if the walls of rooms inside the ship are also arranged along the grid lines. This, however, requires certain stipulations in room dimensions with respect to the grid, i.e., for a basic grid line spacing of 30 or 60 cm, the length and width of the rooms must be multiples of 30 or 60 cm. This requirement also applies to the arrangement of bulkheads and longitudinal walls according to the invention. In this manner, the rooms arranged inside the ship, including their equipment, can be completely standardized and prefabricated.

It is additionally advantageous if entire rooms are designed as functional units or modules incorporated into the grid. These can then be brought into the ship through a somewhat larger assembly opening and, once inside the deck on which they are to be arranged, they can be manipulated to their proper location and position.

The same procedure can be used not only for living quarters, but also for other types of rooms, such as, for example, storerooms, workshops, utility rooms, stock rooms, gangways and operating rooms.

The dimensions of apparatus, functional units, modules, pallets, assembly openings, etc., adapted according to the inventive unit grid principle are preferably designated and recognized by coded numerical values derived from the basic grid unit. Thus, the length of a particular support base, assembly opening, apparatus, or room corresponds to the number of grid line spacings which the respective structural element spans. For example, if the code for a living quarter is based on the lateral grid line spacing of 60 cm, the type designation for a living quarter, for example, consists of a two-digit number, the first digit representing the length, and the second digit representing the width. Type 54, for instance, indicates a length of 5×60 cm=300 cm and a width of 4×60 cm=240 cm.

Apparatus for which the height must also be accounted for in the modular grid system is designated and identified by a third digit in the code. An apparatus of type 112, therefore, has length and width corresponding to one grid line spacing and a height corresponding to two grid line spacings.

Based on a basic grid unit dimension of 60 cm, for example, the dimensions of a container cover can exceed those of the grid unit by 22 cm, while the dimensions of a container which is to be placed in an opening within a unit foundation are 8 cm smaller than the grid unit.

In the design of pallets and support frames and also support bases for simple apparatus, using the concept of the invention, the mounting points on the deck and also on bulkheads and walls must preferably coincide with grid lines, as there are always reinforcements at these locations. The inventive grid unit system is therefore to be considered in the development and design of functional units, pallets, modules, functional blocks, etc.

Based on the grid unit system according to the invention, the uniformly designed ship's hull not only has standardized support bases and transport passages, but also standardized structural components for the construction of the hull. The standardized frame and longitudinal bond spacings, together with a standardized deck height, generally result in better load distribution and make possible uniform structural details and reduces the number of structural components required. Consequently, for the construction of the ship's hull, a limited number of standardized knee plates are required; this is particularly so with regard to the welding and design of the end connections of standardized bulkhead and wall reinforcements, web plates and keel plate reinforcements, standardized corner joints serving as wall or deck reinforcements, and standardized buckling strips.

A support structure adapted in general to the grid unit principle lends itself to standardization of rooms and structural components and to simplification of the entire ship's structure, resulting in cost reductions in the planning, design and construction of the ship. This applies to the ship's hull as well as to the apparatus support bases, the substructures for floors, the assembly openings, the cable trays, etc. Reduced construction time and improved quality are also achieved.

A significant advantage of the grid unit system according to the invention is the general possibility of using the existing functional units to design all other on-board systems as functional units, modules, etc., and integrate them into the ship by appropriate adaptation (ship/functional unit).

Expansion based on prefabricated and pre-equipped functional units, modules, pallets is therefore also possible for practically all on-board systems, such as deck houses, masts, machine units, conveying systems, ventilation systems, ammunition storage areas, pipeline groups, etc. This means that a considerable amount of the work can be done in shops as fabrication outside of the ship resulting in a significant reduction in on-board work.

A ship built according to the grid unit principle can, therefore, be planned, designed and constructed with better quality at lower cost, and made more adaptable and future-oriented. The improvements in repair, maintenance, reconditioning and retrofitting conditions can significantly reduce the costs incurred during the operational life of the ship or the offshore rig, as the case may be.

BRIEF DESCRIPTION OF THE DRAWINGS

A more detailed understanding of the invention may be had from the following description of preferred embodiments to be read and understood in conjunction with the accompanying drawing in which.

DESCRIPTION OF THE PREFERRED EMBODIMENTS

The description hereinafter refers to a ship, in particular a warship as an example; the invention is also applicable to an offshore rig or any similar structure.

Figure 1:
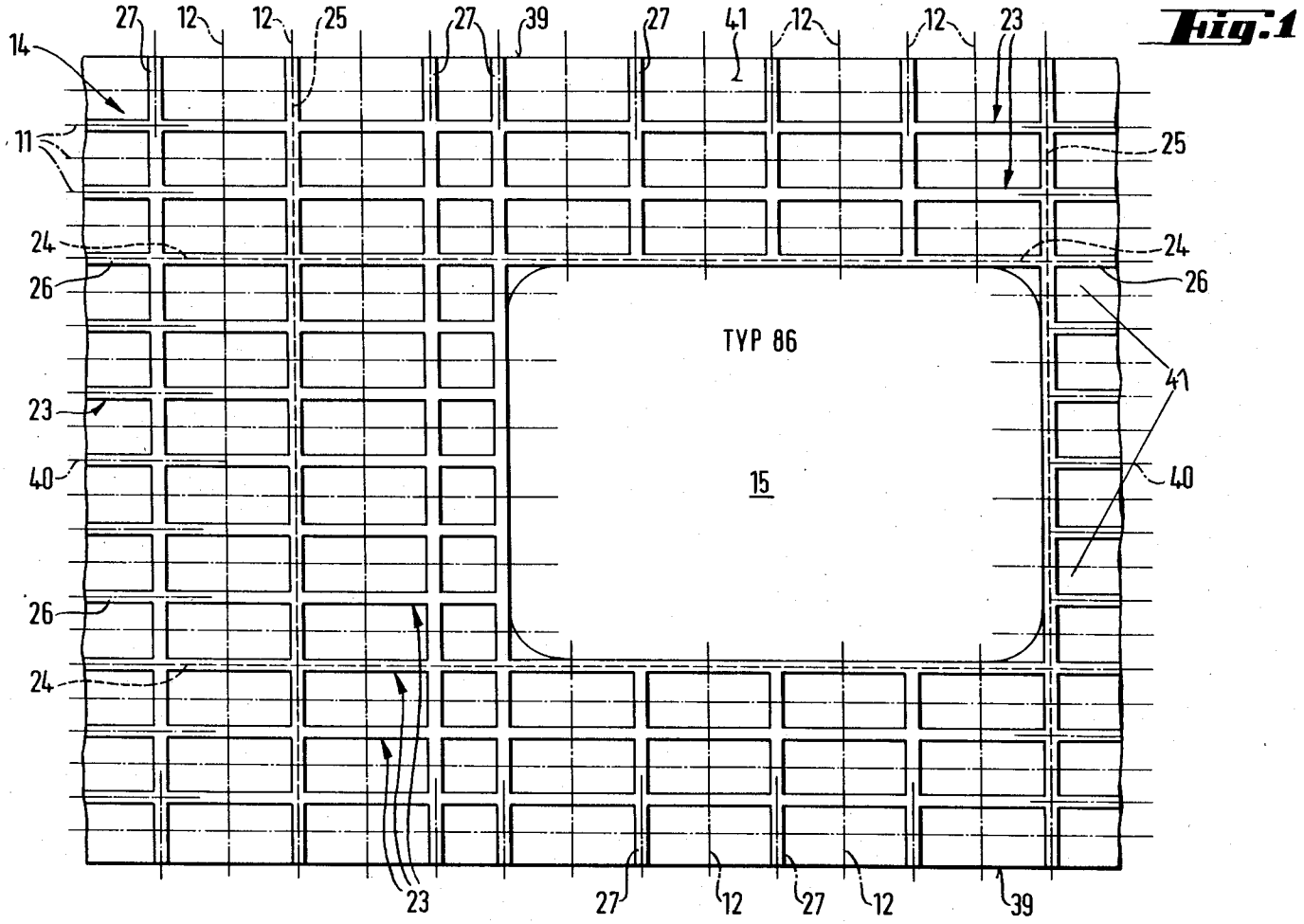
FIG. 1 shows a schematic plan view of a section of a ship constructed according to the grid unit system, in the area of an opening for a weapon container.

As shown in FIG. 1, longitudinal grid lines 11 are arranged at equal intervals, for example, of 30 cm between the vertical outer walls 39 of a ship. The vertical longitudinal central plane 40 of the ship is located at a distance corresponding to 12 longitudinal grid line spacing from the outside walls 39; thus, as illustrated, there are 23 longitudinal grid lines 11 between the side walls 39 of the ship.

Lateral grid lines 12 run perpendicular to the longitudinal grid lines 11, also at equal predetermined intervals, for example, 60 cm. The longitudinal grid lines 11 and the lateral grid lines 12 together form a unit grid 14, which is placed in the plan of the ship's hull as shown in FIG. 1. Since the unit grid 14 is used as the basis for all horizontal planes of the ship and particularly in all decks and on the bottom, the grid lines are to be considered as horizontal sections of vertical grid planes.

With reference to FIG. 1, lateral support elements 27 are located along every other lateral grid line 12; these can be formed from cross frames or cross beams, for example. With respect to the third lateral support element 27 from the left, an additional lateral support element 27 is located at a distance of, for example, one lateral grid line spacing 12, in order to reinforce and increase the strength of the ship's deck 41 in this area.

In the lateral direction—starting from a side wall 39—deck girders 23 or longitudinal beams 26 are arranged along every other longitudinal grid line 11.

Along the second lateral support element 27 from the left, and along the upper longitudinal beam 26, a lateral bulkhead 25 or longitudinal wall 24 is located at one level different from the deck, i.e., above or below the deck 47. (See FIG. 7).

As shown in FIG. 1, the longitudinal support elements 23,26 and lateral support elements 27 are interrupted by an opening 15 in the deck 41, which spans eight lateral grid line spacings and, in the lateral direction, twelve longitudinal grid line spacings, i.e., the opening 15 is incorporated into the grid unit 14. The corners of the opening are rounded off as shown, in order to minimize discontinuity stresses and stress concentrations.

Based on a length of eight grid units and a width of twelve half-units, the opening 15 is designated Type 86, the first digit representing the length and the second digit representing the width in lateral grid line spacings. The opening 15 can be specified, for example, in the following description of the incorporation of a weapon container 16, with the aid of FIGS. 2, 4 and 4*a*.

Figure 2:
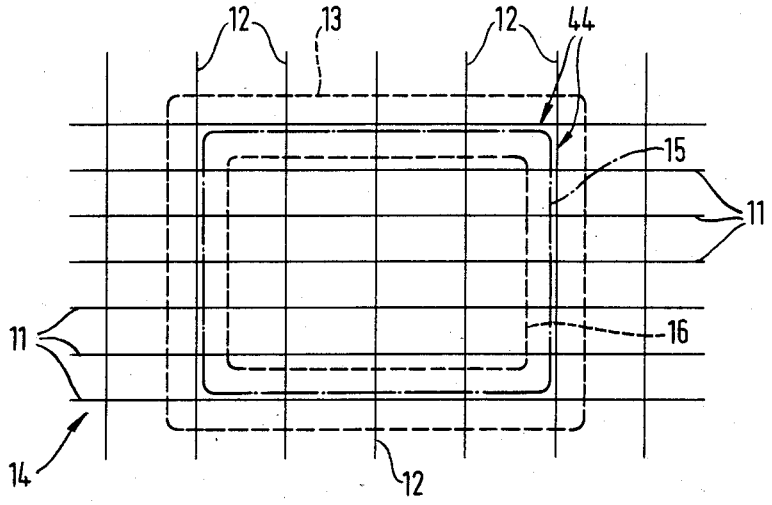
FIG. 2 shows a plan view of the upper deck of a ship according to the invention, in the area of a unit foundation surrounding on opening.

As diagrammatically illustrated in FIG. 2, the opening 15 is adapted to the grid 14 in such a way that the edges of the opening 15 do not practically coincide with longitudinal or lateral grid lines 11 or 12, but are actually situated slightly inside these grid lines. The weapon container 16 adapted to the grid unit principle according to the invention has a somewhat smaller cross section than the opening 15, while the unit foundation 13, on which the unit platform of the weapon container 16 is placed, projects out on all sides beyond the grid lines 11, 12 which define the opening 15, diagrammatically represented in FIG. 2 by the outer most dashed line.

Figure 4:
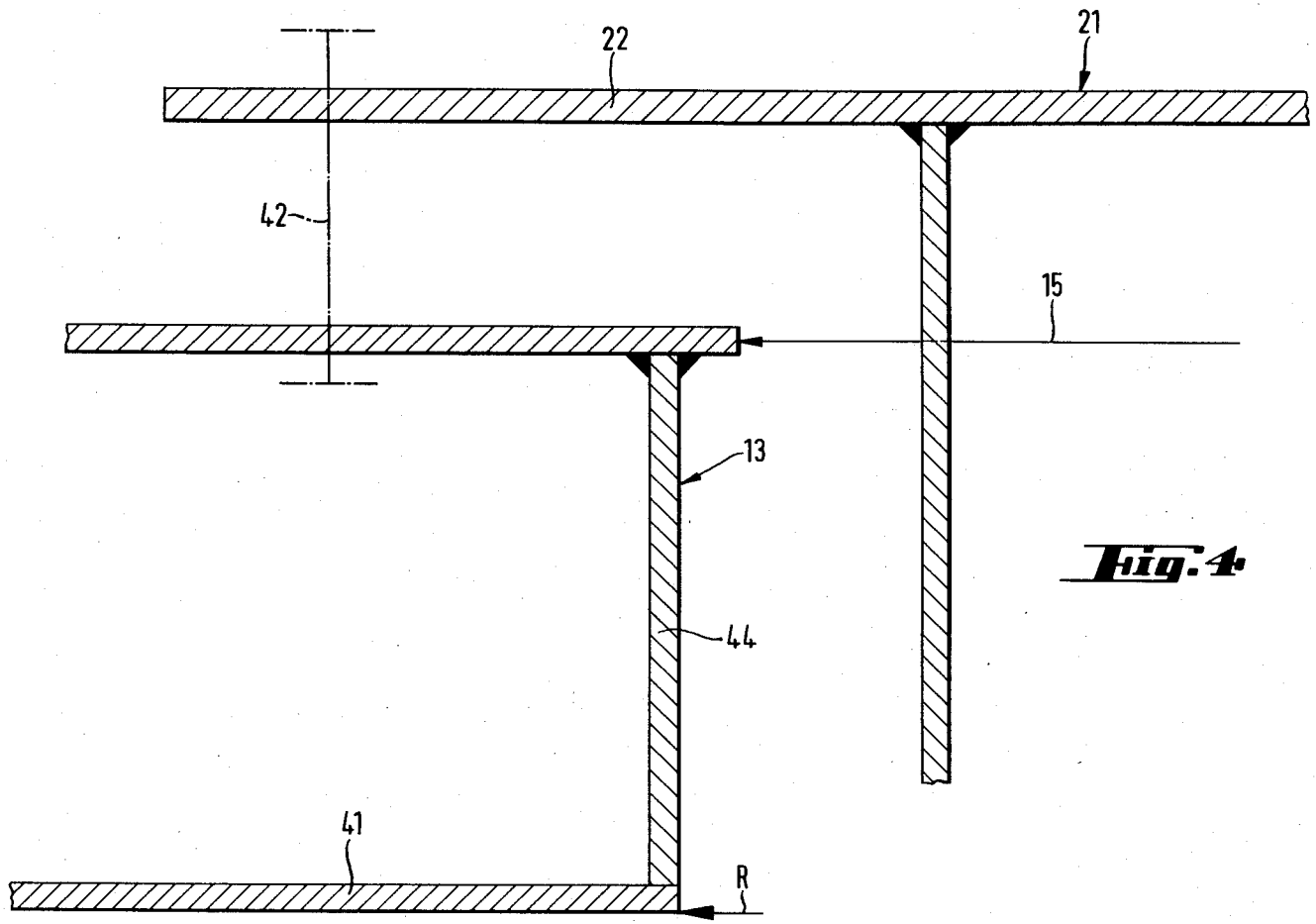
FIG. 4 shows an enlarged schematic vertical section of a ship according to the invention, on the area of the joint between a functional unit and a unit foundation.

As illustrated in FIG. 4, a unit platform 21 which carries a weapon, for example, is furnished with mounting flange covers 22 and extends beyond the opening 15. The weapon container 16 is bolted on underneath the unit platform 21.

The flange cover 22 overlaps with the unit foundation 13, as shown schematically in FIG. 4. As the dimensions indicate in FIG. 2, the weapon unit 16, which is standardized, is easily passed through the opening 15 until the flange cover 22 lies on the unit foundation 13. In the example illustrated in the drawings, the width of the weapon unit is, for example, 8 cm. smaller than a multiple of the spacing of the lateral grid lines 12, which may be 60 cm. The flange cover 22 is then mounted on the unit foundation 13 by means of the fastener 42 shown only schematically in FIG. 4. The grid unit R, i.e., the point at which the grid line 11 or 12 is perpendicular with respect to the plane of the drawing in FIG. 4, is indicated by an arrow in FIG. 4.

Figure 4A:
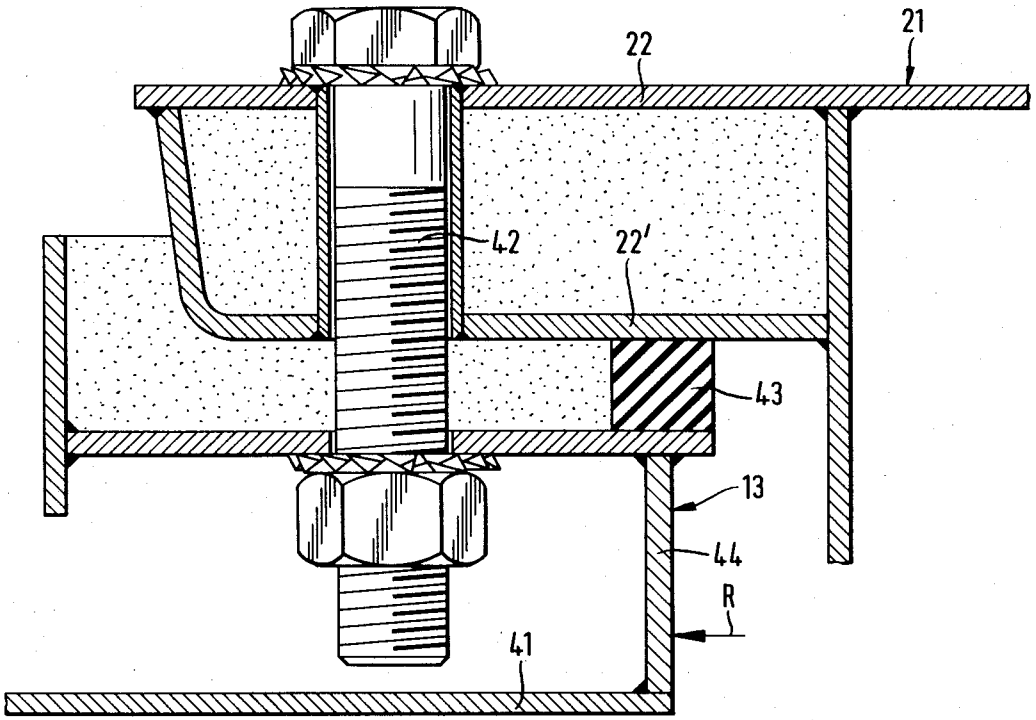
FIG. 4*a* shows a sectional view similar to FIG. 4 detailing the arrangement of a unit platform on a unit foundation.

FIG. 4*a* illustrates how the arrangement shown only schematically (in FIG. 4) can appear in an actual structure. The flange cover 22 is shaped into a fabricated foam filled hollow body by means of an L-shaped piece 22', and pressed against a resin mass in assembly on the unit foundation 13 by means of mounting bolts 42. A rubber gasket 43 seals in the resin during assembly.

The unit foundation is mounted on and attached to the ship's deck 41 by means of a web 44.

A difference in elevation between the unit platform 21 and the ship's deck 41 is not a disadvantage, especially if the installation arranged on the unit platform 21 is one that projects prominently over the deck, for example, a weapon or navigational system. The unit platform 21 can, however, support a deck house or other, larger structure arranged on the ship upper deck.

The opening 15 is required only if a weapon container 16 is arranged beneath the unit platform 21. For smaller weapons, and also for deck houses and similar structures, the opening is not necessary so that, in such case the deck 41 and also the longitudinal and lateral support elements 23, 26 or 27 are not interrupted, unlike as is shown in FIGS. 1, 4 and 4*a*.

Figure 3:
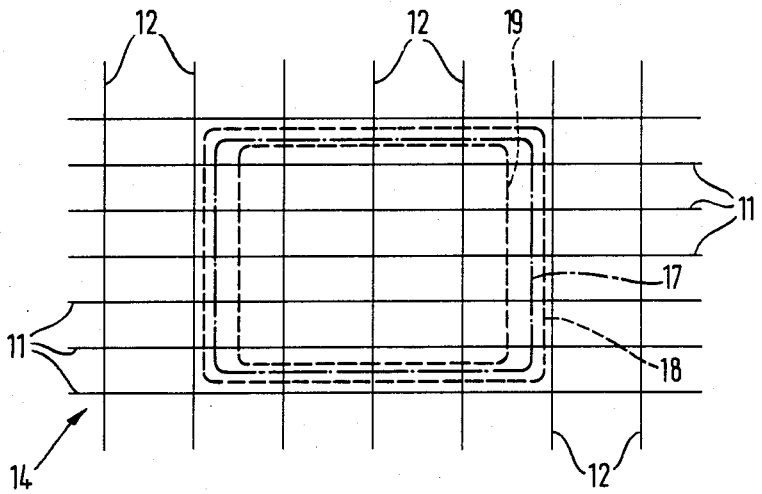
FIG. 3 shows a plan view of a ship's deck of a ship according to the invention, in the area of an assembly opening.
Figure 5:
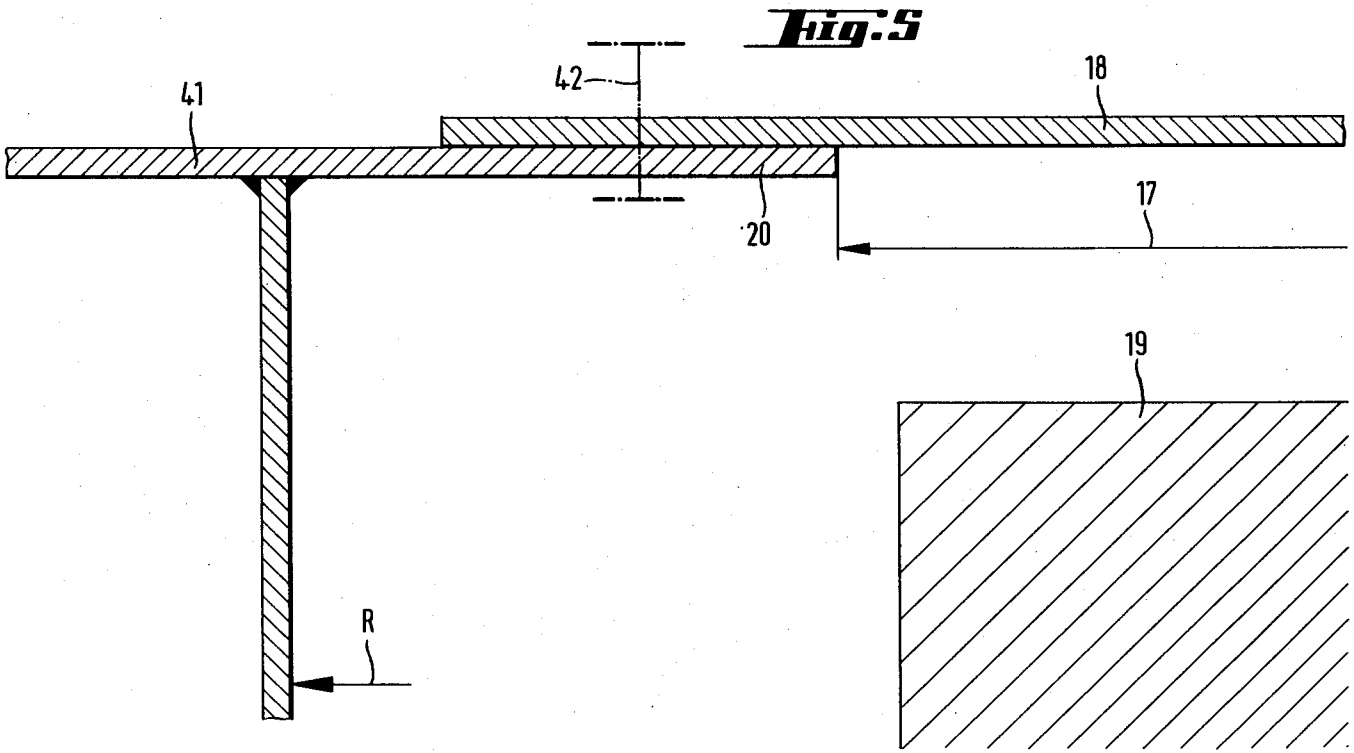
FIG. 5 shows an enlarged vertical section similar to FIG. 4, showing the arrangement of an assembly cover on a ship's deck.
Figure 5A:
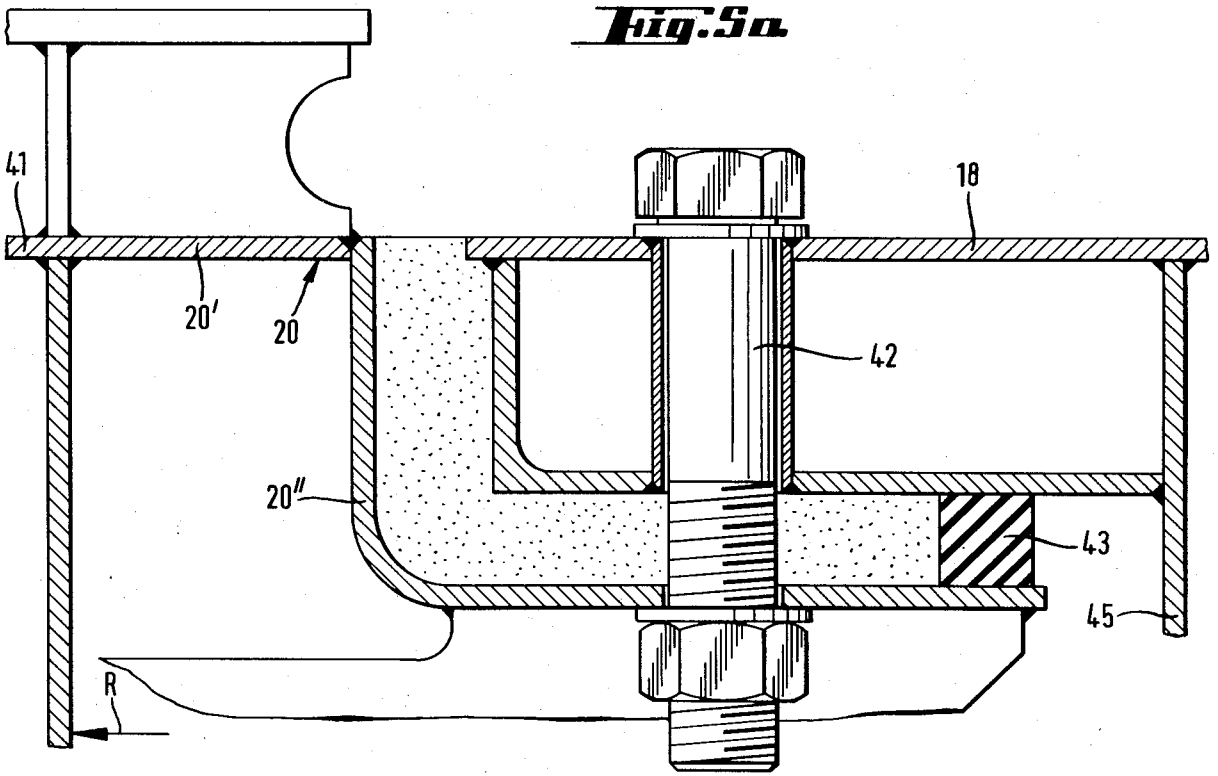
FIG. 5*a* is a detailed view of the schematic representation of FIG. 5.

While in the example according to FIGS. 1, 4 and 4*a*, the unit foundation 13 and the flange cover 22 of the unit platform 21 project out above the grid unit R, the situation is different in the arrangement of an assembly opening 17 according to FIGS. 3, 5 and 5*a*, because after the assembly opening is covered, there should be practically no change in elevation between the deck 41 and the assembly cover 18.

Sometimes the arrangement of assembly openings inside the ship is such that it is generally not possible to allow the cover to project out over the grid unit (R) and to mount it there. For this reason the assembly opening 17 illustrated in FIG. 3 is clearly smaller than the corresponding grid unit. In this way, as shown in FIG. 5, a flange 20 projects inside, onto which the overlapping assembly cover 18 can be mounted with the fasteners 42.

The apparatus 19 to be passed through the assembly opening 17 must be somewhat smaller in cross section than the assembly opening 17. Preferably, the apparatus is one unit smaller in width and length than the grid on which the dimensions of the opening 17 are based. The assembly cover 18 advantageously lies entirely inside the grid.

According to FIG. 5*a*, which illustrates an actual, preferred structural arrangement of the basic concept shown in FIG. 5, the flange 20 is comprised of a flat piece and a welded-on L-profile 20' or 20'' which extends downward. Mounting bolts 42 are used to press the hollow assembly cover 18 against a seating of resin placed between the cover and the L-shaped profile; a sponge rubber gasket 43 seals in the resin during assembly. If necessary, a projecting piece 45 can be added underneath the assembly cover to accommodate any type of apparatus.

Figure 7:
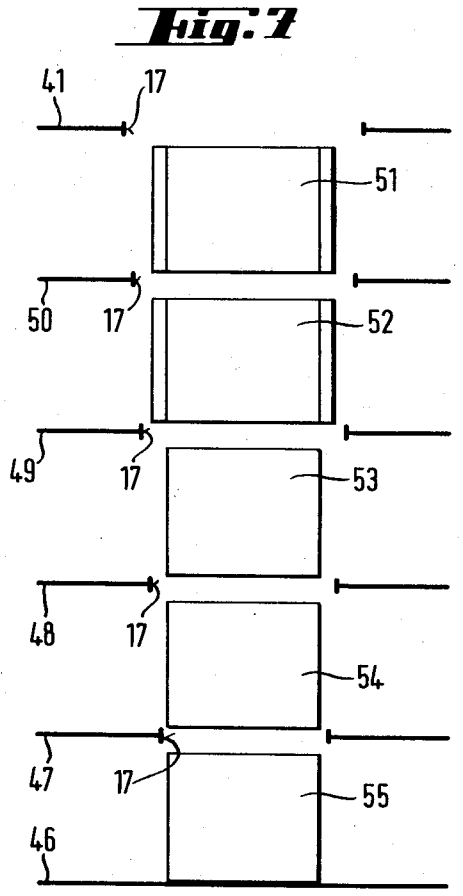
FIG. 7 is a cross-section of the view in FIG. 6.
Figure 6:
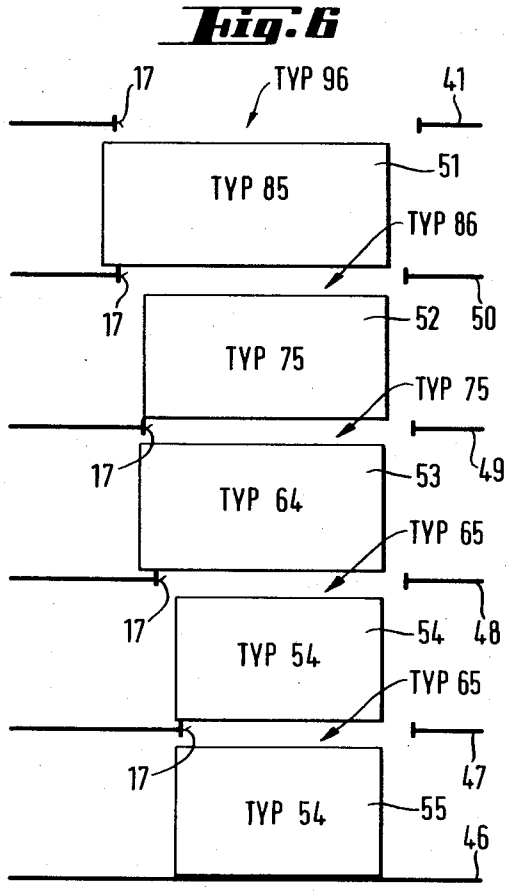
FIG. 6 shows a schematic vertical longitudinal section through a ship's hull, illustrating the introduction of various types of apparatus into the interior of the ship's hull.

In FIGS. 6 and 7, the bottom of the ship and the six decks above it are represented respectively by the reference numerals 46, 47, 48, 49, 50 and 41.

An assembly-opening of the type hereinafter called Type 96 is located in the upper deck 41. This means that the assembly opening 17 is arranged in a grid area which is nine lateral grid line spacings long and 6 lateral grid line spacings wide, taking into account the reductions in size according to FIGS. 3, 5 and 5*a*. An apparatus 51 of Type 85 can therefore fit through the upper assembly opening 17; the height of the apparatus must be somewhat smaller than the distance between decks 41 and 50. Beneath the assembly opening 17, the apparatus of the Type 85 can then be shifted to the side as illustrated in FIG. 6.

Deck 50 has an assembly opening 17 of Type 86, through which an apparatus 52 of Type 75 can be passed into the space between decks 49 and 50. Similarly, the lower decks 49, 48, 47 have assembly openings 17 of Type 75, 65 and 65, respectively, which can accommodate apparatus 53, 54, 55 of Types 64, 54 and 54, respectively.

The rooms into which the apparatus 51, 52, 53, 54 and 55 are placed are also adapted to the unit grid system according to the invention, with lengths of 480, 540 or 600 cm and widths of 300, 360 or 420 cm, respectively.

Figure 8:
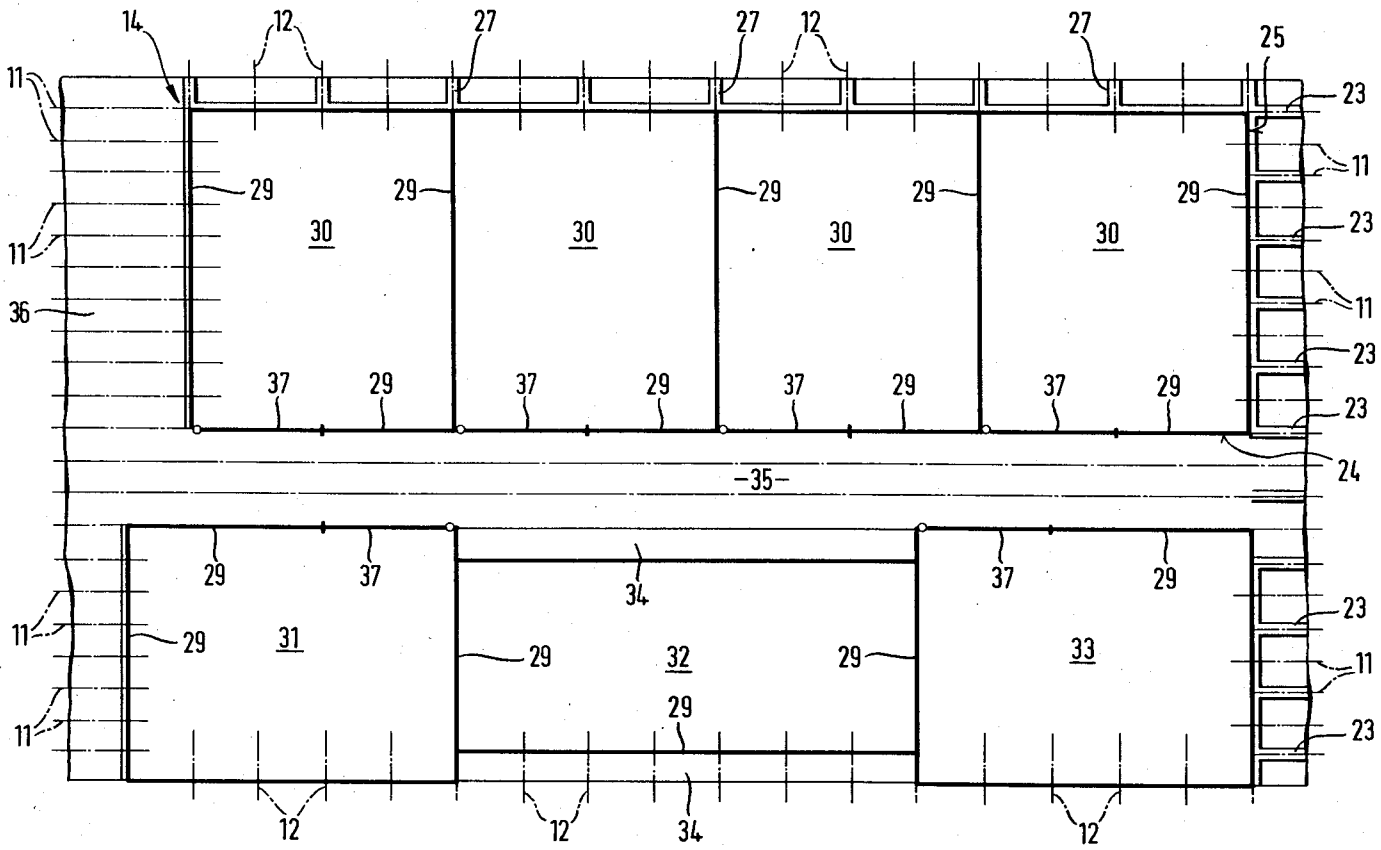
FIG. 8 shows a schematic, partially cutaway plan view of a deck equipped with rooms on a ship according to the invention.

FIG. 8 shows how living quarters 30, a washroom 31, a ventilation room 32, a shower room 33 and switch cabinets 34 can also be incorporated in the unit grid system according to the invention.

The walls 29 of the rooms are arranged along grid lines 11 or 12. Longitudinal walls and lateral bulkheads may also be present in the ship. Between the rooms, longitudinal and lateral walkways 35 or 36 may also be adapted to the grid system. The walls 29 of the various rooms are equipped with doors 37 leading to the walkways 35 or 36.

The rooms 30 through 34 can also be prefabricated as containers with their respective equipment and then transported through assembly openings into the ship's interior.

Figure 9:
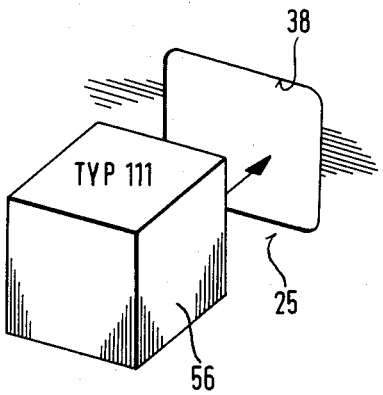
FIG. 9 is a schematic perspective view of an access opening in a bulkhead, with a schematic representation of an apparatus to be transported through the access opening.

As shown in FIG. 9, a bulkhead 25 is equipped with an essentially square access opening 38 having equal length and width, for example, of 66 cm. Assuming that the basic grid unit dimension is 60 cm, the access opening 38 is 6 cm larger on each side than the grid unit. In this manner an apparatus 56 of the type 111 dimensioned according to the grid unit system can be transported through the access opening 38, as long as the apparatus is in the form of a cube having dimensions corresponding to the basic spacing of the lateral grid lines. The arrow in FIG. 9 indicates the transport direction of the apparatus 56. In the direction of the arrow, the apparatus may also have a dimension corresponding to a multiple of the grid unit dimension.

Figure 10:
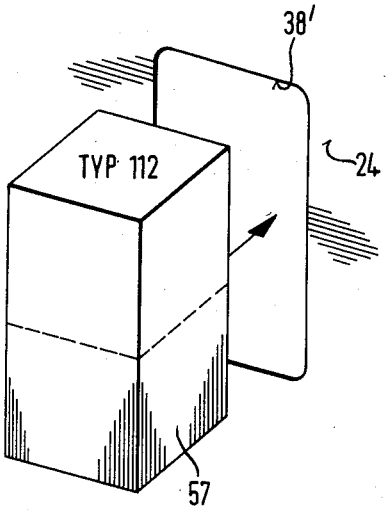
FIG. 10, 11 show perspective views analogous to FIG. 9, but with larger access openings and larger apparatus to be transported through the openings.

FIG. 10 shows an upright access opening 38′ in a longitudinal wall 24. This opening 38′, in addition to having a width of a single grid unit spacing and a height of a double grid unit spacing, is slightly larger, for example, by 6 cm, so that an apparatus 57 of the type 112 dimensioned accordingly can be transported through this opening.

Figure 11:
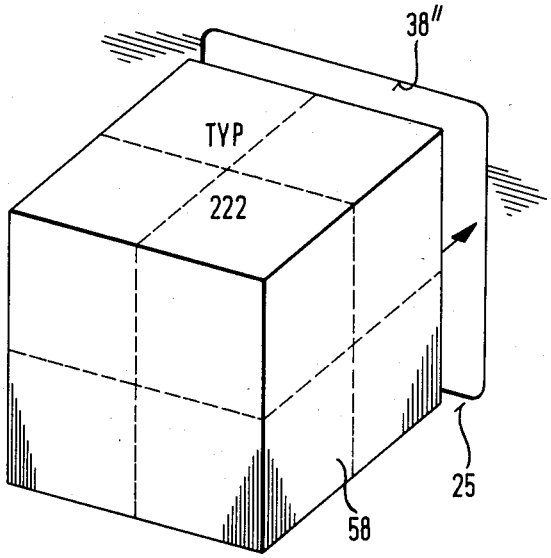

FIG. 11 shows an access opening one grid unit large than that in FIG. 10, so that an apparatus 58 of the type 222 one grid unit larger can easily pass through this larger opening 38″.

Figure 12:
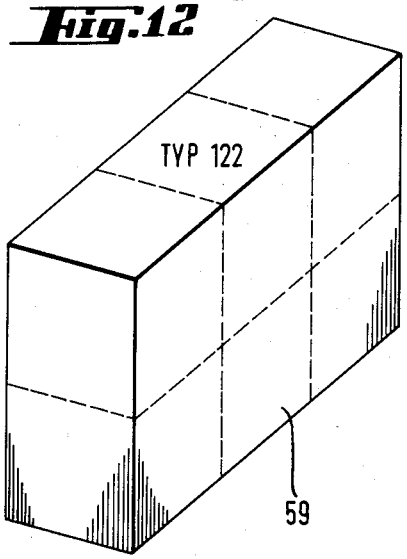
FIG. 12 shows a perspective view of an apparatus three time as long as that in FIG. 10, but which fits through the same access opening shown in FIG. 10.

FIG. 12 shows an apparatus 59 of the type 122 elongated with respect to FIG. 10, which also fits through the access opening shown in FIG. 10.

The foregoing are only some preferred exemplary embodiments constructed using the principles of the invention. The invention is not to be taken as limited to all the details thereof, since, modifications and variations of the invention are possible and may be made without departing from the spirit or scope of the invention.

What is claimed is:

1. A maritime structure of the type having a plurality of vertically spaced decks each having a length and a width, at least one deck among said decks being adapted to receive foundation seatings for equipment and apparatus disposed to form a system in said maritime structure, said system comprising:

substantially horizontal load bearing elements which are disposed longitudinally and transversely, said load bearing elements supporting at least said one deck and at least in part being substantially aligned with selected ones of longitudinal and transverse grid lines which are formed of a plurality of uniformly spaced longitudinal grid lines along the length of each deck at a known first grid spacing, and a plurality of uniformly spaced lateral grid lines parallel to said each deck width and spaced at a known second grid spacing, said first grid spacing and second grid spacing having a predetermined relationship, wherein at least said one deck is provided with rectangular assembly openings constituting said foundation seatings;

some of said longitudinal load bearing elements being disposed in a given vertical plane on superjacent decks in paired beams, at least some of said paired beams including therebetween vertical load bearing wall-members, at least some of said vertical load bearing wall-members having access openings of predetermined dimensions which are derived from said first and second grid spacings, whereby said apparatus and equipment can be prefabricated with predetermined dimensions which are standardized in terms of said first and second grid spacings, and whereby at least some of said apparatus and equipment can be transported through at least some of said access openings.

2. The maritime structure as in claim 1 with said system adapted such that said second spacing between consecutive lateral grid lines is twice said first spacing between consecutive longitudinal grid lines for spacing said load bearing elements.

3. The structure as in claim 2, wherein said second spacing between lateral grid lines is approximately in the range of 50 cm. to 70 cm.

4. The structure as in claim 3, wherein said second spacing is 60 cm.

5. The structure as in claim 1, wherein a plurality of said decks are provided with assembly openings constituting said foundation seatings, at least some of said openings having longitudinal dimensions substantially corresponding to an integral multiple of said second grid spacing between consecutive of said lateral grid lines.

6. The structure as in claim 5, wherein said at least one deck which has foundation seatings, also includes a plurality of additional load bearing support elements in the form of beams arranged at selected ones of said longitudinal and lateral grid lines.

7. The structure as in claim 6, wherein at relatively more heavily stressed areas of said at least one deck, said load bearing beams are arranged at consecutive ones of longitudinal and lateral grid lines.

8. The structure as in claim 6, wherein at least some of said assembly openings are slightly smaller than a periphery defined by the longitudinal and lateral grid lines which are closest to the periphery of a corresponding opening.

9. The structure as in claim 1, wherein at least one of said access openings is at least as high as it is wide.

10. The structure as in claim 9, wherein the width of said at least one access opening is 5 to 15% larger than said second spacing between successive lateral grid lines.

11. The structure as in claim 10, wherein said height and width are about 10% larger than the spacing of the lateral grid lines.

12. The structure as in claim 10, wherein said at least one opening has a height which is substantially an integral multiple of the width of said at least one access opening.

13. The structure as in claim 1, including at least one fabricated room disposed vertically and supported by at least one deck, wherein the room includes vertical walls which align with selected ones of said longitudinal and lateral grid lines.

14. A maritime structure comprising a vessel with several vertically spaced decks having mountings for receiving certain devices comprising fixtures and apparatus, said mountings being formed selectively from longitudinal support elements which include longitudinal beams, longitudinal strips, deck girders, longitudinal walls and longitudinal bulkheads, as well as selected ones of lateral support elements which include cross beams, cross frames, frame girders, spars, lateral walls and lateral bulkheads which are arranged in parallel and at intervals, wherein between some of the support elements of superjacent decks are arranged one or more of load bearing longitudinal walls and bulkheads, which are disposed to function as vertical support members, and of which at least one is equipped with access openings, wherein said longitudinal support elements and said lateral support elements are arranged along uniformly spaced longitudinal and lateral grid lines of a unit grid incorporated into a basic plan of the vessel, wherein at least said fixtures and apparatus are incorporated into said unit grid and wherein substantially square access openings are incorporated into the grid, wherein at least some of said access openings are made slightly larger in height and width than the grid unit;

said structure including assembly openings adapted to receive said fixtures and apparatus, said structure including webs which substantially form inside edges of said openings, said webs coinciding with selected grid lines, and including bearing-surfaces for certain mounting-flanges of said fixtures and apparatus, wherein said bearing surfaces project outwardly beyond said selected grid lines, and wherein said assembly openings include edges which are offset to the inside of selected ones of said grid lines in order to accommodate a flange for mounting an assembly cover on said assembly opening.

15. The vessel according to claim 14, wherein the height and width of said at least some access openings is 5 to 15% larger than the spacing of the lateral grid lines.

16. The vessel according to claim 15, wherein said height and width are about 10% larger than the spacing of the lateral grid lines.

17. The vessel according to claim 15, wherein access openings are furnished of width corresponding to a single lateral grid line spacing, and height corresponding to an integral multiple of said lateral grid line spacing.

18. The vessel according to claim 14, including rooms having walls arranged inside the vessel, which walls also are aligned with selected ones of said grid lines.

19. The vessel according to claim 18, wherein said rooms are designed as functional units and modules incorporated into the grid unit system.

* * * * *